United States Patent [19]

Schweers

[11] 4,037,726

[45] July 26, 1977

[54] MULTIPLE SECTION CURTAIN ROD

[75] Inventor: William Edwin Schweers, Maple Ridge, Canada

[73] Assignee: Lawrence Peska Associates, Inc., New York, N.Y. ; a part interest

[21] Appl. No.: 746,069

[22] Filed: Nov. 30, 1976

[51] Int. Cl.[2] ..... A47H 1/022

[52] U.S. Cl. ..... 211/105.5; 224/42.1 CA

[58] Field of Search ..... 211/105.1, 105.2, 105.3, 211/105.4, 105.5, 105.6, 123, 124; 224/42.1 CA; 248/356

[56] References Cited

U.S. PATENT DOCUMENTS

| | | | |
|---|---|---|---|
| 468,987 | 2/1892 | Fowler et al. | 211/105.6 |
| 527,273 | 10/1894 | Fowler et al. | 211/105.6 |
| 1,425,247 | 8/1922 | Galbreath | 211/105.6 |
| 1,639,551 | 8/1927 | Booth | 211/123 |
| 2,032,842 | 3/1936 | Gould | 211/105.6 |
| 3,062,381 | 11/1962 | Maiden | 211/105.6 |
| 3,481,483 | 12/1969 | Harvey et al. | 211/105.3 |

FOREIGN PATENT DOCUMENTS

| | | | |
|---|---|---|---|
| 389,847 | 7/1965 | Switzerland | 248/356 |

*Primary Examiner*—Roy D. Frazier
*Assistant Examiner*—Robert W. Gibson, Jr.

[57] ABSTRACT

A multiple section curtain rod is disclosed in which a rod section is provided having a first and second tubular member fitting over opposite ends of the rod, the tubular members being resiliently biased away from one another in an outward direction to secure the curtain rod in an abutting relation with wall members to be spanned by the rod. A cover is provided over the rod comprising in one instance an accordian pleated tube extending from end to end of the curtain rod, the pleats of which hold curtain hooks.

In another embodiment the curtain rod cover comprises a pair of telescoping tubes extending from end to end of the curtain rod, the outer tube of the telescoping pair having one end extending towards the center of the curtain rod terminating in an end that tapers towards the center of the rod member for slidingly moving curtain hook member over the rod cover.

3 Claims, 4 Drawing Figures

MULTIPLE SECTION CURTAIN ROD

SUMMARY OF THE INVENTION

The present invention relates to a resiliently biased telescoping curtain rod comprising a center rod, a first tubular member telescopingly engaging one end of the rod and a second tubular member telescopingly engaging the opposite end of the rod. A resilient member operatively engaging the telescoping members is provided for biasing the telescoping members outwardly in an abutting relation with wall members to be spanned by the curtain rod. Wall engaging members such as suction cups are provided on the ends of the telescoping members for holding the curtain rod on walls to be spanned by the curtain rod. A collapsible and expandable curtain rod cover member is also provided which surrounds the curtain rod and extends from one end of the first tubular member beyond the rod member onto the end of the second tubular member. The rod cover is adapted to receive curtain hook members.

In one embodiment, the resilient member comprises a coil spring slidingly mounted on the rod and which biases the first and second telescoping tubes outwardly away from one another.

The rod cover comprises in one embodiment, an accordian pleated tubular member surrounding the first and second tubular members and the rod and is adopted to receive curtain hook members in the accordian pleats and hold the curtain hooks in place. In another embodiment, the curtain rod cover comprises a third and fourth tubular member telescopingly collapsible one over the other and which surround the first tubular member the rod and the second tubular member. The third member is adapted to be inserted in the fourth tubular member, the fourth tubular member extending inwardly the inward end of which is gradually tapered towards the center of the third tubular member for slidingly moving curtain hooks over the rod cover.

DETAILED DESCRIPTION OF THE INVENTION

Figure 1:
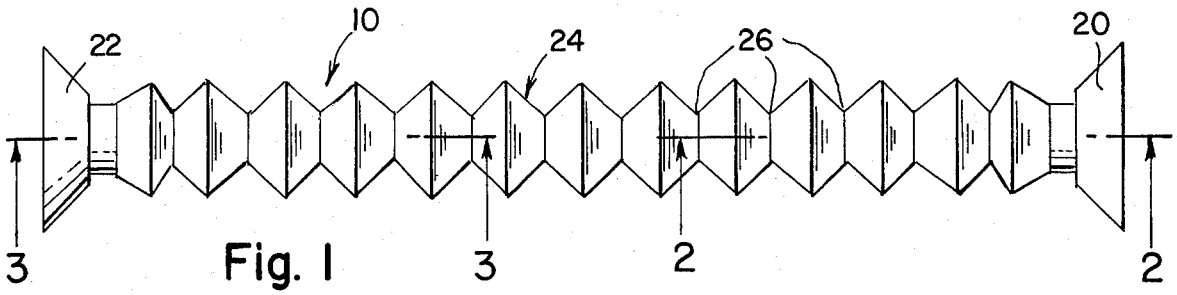
FIG. 1 is a side elevation illustrating a resiliently biased telescoping curtain rod member having an accordian pleated cover thereover according to one embodiment of the present invention.
Figure 2:
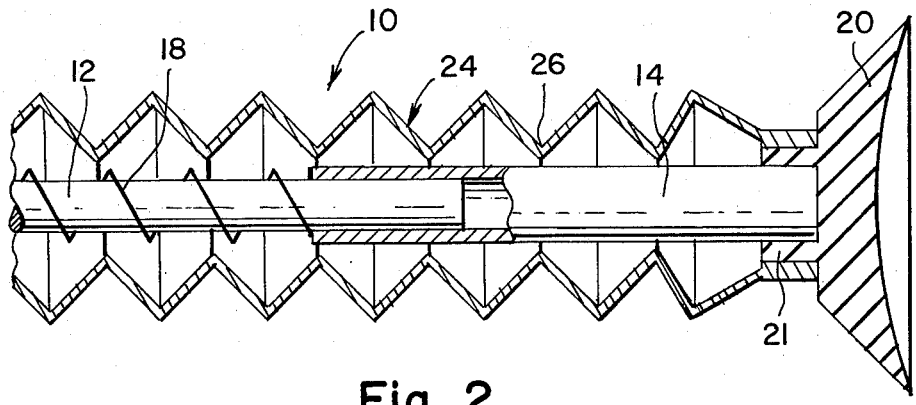
FIGS. 2 and 3 are side elevations in section taken along the lines 2—2 and 3—3 respectively of FIG. 1.
Figure 3:
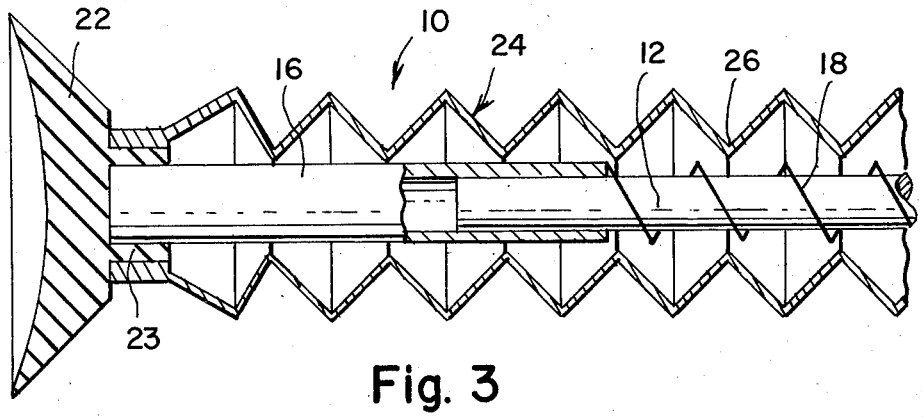

Spring loaded telescoping curtain rods are known in the prior art; however suffer the disadvantage of not being able to hold curtain hooks at preselected positions along the length of the curtain rod or alternately do not allow for the easy sliding of curtain hooks along the length of the curtain rod.

Spring loaded telescoping curtain rods are illustrated by U.S. Pat. Nos. 2,545,251 Baretella; 2,519,996 Blake; 1,868,439 Zielinski; 1,639,551 Booth 1,178,994 Crump; 1,140,570 Buckley and 988,200 Logsdon. U.S. Pat.No. 2,032,842 Gould although not disclosing a resiliently biased rod structure does illustrate the use of tapered ends on the telescoping members of the curtain rod.

Although the Zielinski and the Blake references disclose a plurality of telescoping tubes, i.e., more than two tube members that collapse one inside of the other in a telescoping fashion, neither reference disclosed a curtain rod cover over the telescoping tube members for providing either easy movement of curtain hooks over the telescoping curtain rod or to hold curtain hooks in a fixed position along the length of the curtain rod. In fact, none of the aforementioned prior art references discloses a resiliently biased telescoping curtain rod having a curtain rod cover collapsible placed over the telescoping members for either facilitating the movement of curtain hooks or for holding curtain hooks in a fixed position along the length of a collapsible curtain rod that is resiliently biased outwardly for holding the rod against wall members to be spanned by the curtain rod.

Accordingly, it is an object of the present invention to overcome these and other difficulties encountered in the prior art.

It is a further object of the present invention to provide a resiliently biased telescoping curtain rod having a cover thereover which is capable of expanding and collapsing with the extension and retraction of the curtain rod.

It is a further object of the present invention to provide a resiliently biased telescoping curtain rod having a curtain rod cover over the outer proximity of the curtain rod which is capable of holding curtain hooks in a fixed position along the length of the curtain rod.

It is a further object of the present invention to provide a resiliently biased telescoping curtain rod having a curtain rod cover thereover which facilitates slidingly moving curtain hooks along the length of the curtain rod cover without having the curtain hooks catch on any of the curtain rod cover.

These and other objects have been achieved by the present invention and will become apparent by reference to the disclosure and claims that follow as well as the appended drawing.

Referring to the drawing and FIGS. 1 through 4, a resiliently biased telescoping curtain rod 10 and 100 having a curtain rod cover thereover is illustrated. A rod 12 is provided having a first tubular member 14 telescopically sliding over one end of rod 12 and a second tubular member 16 telescopically sliding over the other end of rod 12, a resilient member such as spring 24 being provided to resiliently bias the telescoping tube members 14 and 16 outward and away from the center of the rod 12 to force the ends of the rod into engagement with wall members to be spanned by the curtain rod 10 or 100. The resilient member in one embodiment comprises a coil spring 18 which is placed around the outside of rod 12, the ends of spring 18 engaging the inwardly facing ends of telescoping rod members 14 and 16.

Suction cups 20 and 22 are secured to the outwardly facing ends of telescoping rods 14 and 16 respectively and are provided to engage wall members to be spanned by the curtain rod 10 or 100.

An accordian pleated rod cover 24 is provided which covers the curtain rod and extends from one outwardly facing end of tube 14 to outwardly facing end of tube 16, the accordian pleated cover being expendable and collapsible as a rod cover. The curtain rod cover 24 is expandable and collapsible as the curtain rod 10 is extended or compressed to span the distance between walls against which the ends of the curtain rod 10 are resiliently biased by spring 18 and held in place by suction cups 20 and 22. The pleats in the accordian sleeve 24 function to hold curtain hooks in place along the length of the curtain rod 10, curtain rod cover 24 functioning not only in this manner but also to protect and cover the mechanism of the telescopically expandable and collapsible curtain rod 10 such as the bar 12 and spring 18. The ends of curtain rod cover 24 fit over the inwardly pointing ends or flange 21 and 23 or suction cups 20 and 22 and are secured to these aforementioned flange members by a friction fit.

Figure 4:
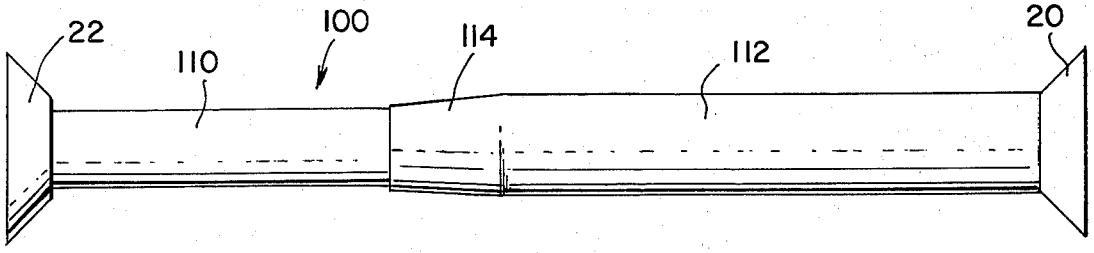
FIG. 4 is a side elevation illustrating a resiliently biased telescoping curtain rod having a rod cover thereover which comprises a telescopically collapsible and expandable pair of tubular members, the inwardly extending end of the tubular member which slides over the other tubular member being gradually tapered toward the center of the other tubular member to enable curtain hooks to be slidingly moved over the curtain rod cover.

In another embodiment, shown in FIG. 4, a curtain rod cover comprising a tubular member 110 surrounding and extending inwardly from the end of tubular member 16 in combination with a tubular member 112 surrounding and extending inwardly from the end of tubular member 14 is provided as a curtain rod cover, tubular member 112 telescopically sliding over and receiving tubular member 110, the inwardly extending end 114 of tubular member 112 being gradually tapered toward the center of tubular member 110 for slidingly moving curtain hook members over the rod cover 110 in combination with rod cover member 112.

In use, the ends of either the curtain rod 10 or 100 on which the suction cups 20 and 22 are mounted are moved towards the center of the curtain rod to compress the spring 18 and the curtain rod then inserted between wall members to be spanned by the curtain rod and the ends thereupon are released so that the spring 18 can resiliently bias the ends against such wall members. With respect to the curtain rod structure or apparatus 10, curtain hooks may be placed in the pleats 26 in the accordian cover 24 and the curtain hooks will be fixed in place by the pleats, i.e., the curtain hooks will be spaced apart from one another in a fixed relationship.

Curtain rod 100 is mounted in the same way as curtain rod 10 however the smooth surface and the tapered end of telescopic tubular member 112 allows curtain hooks to be moved in a sliding lateral direction over the surface of tubular member 112 to tubular member 110 over which member 112 fits.

Although the invention has been described by reference to some embodiments, it is not intended that the novel multiple membered curtain rod apparatus be limited thereby but that modifications thereof are intended to be included as falling within the broad scope and spirit of the foregoing disclosure the following claims and the appended drawings.

What is claimed is:

1. A resiliently biased telescoping curtain rod comprising center rod means, first tubular means telescopingly engaging one end of said rod means, second tubular means telescopingly engaging the opposite end of said rod means, resilient means operatively engaging said telescoping means for biasing said telescoping means away from each other and in an abutting relation with wall members to be spanned by said curtain rod, said resilient means comprising means for biasing both said first tubular means and said second tubular means away from each other, wall engaging means on the ends of said telescoping means for holding said curtain rod on wall members to be spanned by said curtain rod, collapsible and expandable curtain rod cover means surrounding said curtain rod and extending from one end of said first tubular means beyond said rod means and to the end of said second tubular means, said rod cover being adapted to receive curtain hook means, said rod cover comprising third tubular means surrounding and extending inwardly from the end of said first tubular means, a fourth tubular means telescopingly sliding over and receiving said third tubular means, the inwardly extending end of said fourth tubular means being gradually tapered towards the center of said third tubular means for slidingly moving curtain hook members over said rod cover.

2. The resiliently biased telescoping curtain rod of claim 1 where said wall engaging means comprises a first suction cup means mounted on the end of said first tubular means and second suction cup means mounted on the end of said second tubular means.

3. The resiliently biased telescoping curtain rod of claim 2 where said resilient means comprises tubular coil spring means slidingly mounted and surrounding said rod and biasing said first and second tubular means outwardly away from one another.

* * * * *